US005487493A

United States Patent [19]

McNabb

[11] Patent Number: 5,487,493

[45] Date of Patent: Jan. 30, 1996

[54] FROZEN BEVERAGE DISPENSING APPARATUS

[76] Inventor: Rex P. McNabb, P.O. Box 460879, Garland, Tex. 75046

[21] Appl. No.: 247,236

[22] Filed: May 23, 1994

[51] Int. Cl.[6] ..... B67D 5/32

[52] U.S. Cl. ..... 222/153.14; 62/342; 222/146.6; 222/505; 222/511; 251/90; 251/114; 251/120

[58] Field of Search ..... 222/52, 54, 63, 222/146.6, 153.14, 505, 509, 511, 518, 504; 239/553.1, 553.3, 553.5; 251/90, 111, 114, 116, 120, 127; 62/136, 342, 343, 392

[56] References Cited

U.S. PATENT DOCUMENTS

| | | | |
|---|---|---|---|
| 1,473,774 | 11/1923 | Leech, Jr. | 251/90 |
| 3,255,938 | 6/1966 | Dimmich et al. | 222/205 |
| 3,502,111 | 3/1970 | Hansen | 251/120 X |
| 3,589,564 | 6/1971 | Keller | 222/153.14 |
| 3,891,180 | 6/1975 | Bebinger | 251/120 |
| 4,226,343 | 10/1980 | Fling | 222/504 |
| 4,655,374 | 4/1987 | Guerette | 222/518 X |
| 4,911,333 | 3/1990 | Wilson | 222/153.14 |
| 4,934,566 | 6/1990 | Guerette | 222/505 X |
| 5,394,715 | 3/1995 | Guerette | 251/90 X |

*Primary Examiner*—Kevin P. Shaver
*Attorney, Agent, or Firm*—W. Kirk McCord

[57] ABSTRACT

Improved frozen beverage dispensing apparatus includes a latch member for inhibiting operation of the dispensing apparatus when the apparatus is in a defrost cycle. The apparatus includes a container for storing a beverage under pressure in at least a partially frozen state, a normally closed dispensing valve mounted with the container and a manually operable lever for operating the dispensing valve. The dispensing valve has a longitudinal bore communicating with the interior of the container. A defrost relay operates a solenoid at the onset of the defrost cycle to move the latch member into engagement with the lever. When the defrost cycle has been completed, the solenoid disengages the latching member from the lever so that the lever can be operated to open the dispensing valve. A faucet member extends downwardly from the dispensing valve. The faucet member includes a diffusion member for diffusing the frozen beverage passing through the faucet member generally outwardly from a central axis of the faucet member and downwardly. In one embodiment, the diffusion member is a diffusion valve which is biased toward a closed position to prevent passage of the frozen beverage through the faucet member when the dispensing valve is closed.

22 Claims, 6 Drawing Sheets

FROZEN BEVERAGE DISPENSING APPARATUS

FIELD OF THE INVENTION

This invention relates to apparatus for dispensing frozen beverages and in particular to improvements in frozen beverage dispensing apparatus.

BACKGROUND ART

Both carbonated and non-carbonated beverages may be stored in a frozen or partially frozen state and dispensed in the form of a slush. Typically, frozen or partially frozen beverages are stored and dispensed under pressure.

One problem associated with prior art apparatus for dispensing frozen beverages is that refrigerant is typically stored under relatively high pressure (e.g., 37 psi) in a storage tank or the like. A dispensing valve is connected to the storage tank and is operable by means of a lever or other manually operable device. When the valve is open, there is often a sudden blast of the pressurized beverage, which cannot only result in an unpleasant surprise to the person operating the dispensing valve, but can also result in loss of control of the cup or other container used to capture the beverage by the person operating the dispensing valve. The problem is exacerbated when the dispensing apparatus is in a defrost cycle. During the defrost cycle the beverage may be at least partially melted. If the dispensing valve is operated during the defrost cycle, the beverage will be dispensed at an even greater force because it is in a more liquid state.

Another problem associated with prior art dispensing apparatus is the problem or residual leakage after the dispensing apparatus has been operated. Typically, some of the beverage will be present in the dispensing valve body downstream of the valve seat. Even after the dispensing valve has been closed, this residual material may leak from the dispensing faucet connected to the valve body.

U.S. Pat. No. 4,911,333 discloses a beverage dispensing valve having a valve seat with a specially designed passageway that directs the frozen material radially outward toward the walls of the valve bore rather than axially toward the valve outlet. A manually operable lever is used to move a valve pin into and out of engagement with the valve seat to close and open the valve, respectively. A lockout mender engages an opening in the valve pin to prevent the valve pin from being moved to the open position when the dispensing apparatus is in a defrost cycle. The lockout member engages the valve pin inside the valve body.

Although the valve seat disclosed in U.S. Pat. No. 4,911,333 reduces the dispensing pressure, the dispensing valve is still subject to leakage after the valve is closed because of the frozen material inside the passageway of the valve seat and in the faucet portion beneath the valve seat, particularly after the frozen material has melted. Another problem associated with the dispensing apparatus of U.S. Pat. No. 4,911,333 is that the lockout member engages the valve pin inside the valve body, such that the lockout condition is not apparent to one who may attempt to operate the valve, such as a member of the general public. Forceful operation of the lever may disengage the lockout member from the valve pin or even break the lockout member.

There is therefore a need for improved frozen beverage dispensing apparatus to overcome the aforementioned problems of dispensing pressure and leakage.

DISCLOSURE OF INVENTION

In accordance with the present invention, apparatus for dispensing material in at least a partially frozen state is provided. The apparatus includes a container for storing the material under pressure and a valve mounted with the container for controlling the dispensing of the material. The valve includes a valve body with a bore communicating with the interior of the container, closure means disposed in the bore and being adapted to close the bore to prevent material from passing therethrough when the closure means is in a first position, and actuating means for moving the closure means to a second position wherein the material is allowed to pass through the bore. The closure means is normally in the first position for closing the valve. A portion of the actuating means is external to the valve body.

In accordance with one feature of the invention, the apparatus includes securing means for automatically engaging the external portion of the actuating means in response to a predetermined condition, to prevent the actuating means from being able to move the closure means to the second position, whereby the closure means is secured in the first position to prevent the material from being dispensed.

In one embodiment, the predetermined condition corresponds to a defrost cycle of the apparatus. The securing means secures the valve in at closed position during the defrost cycle to inhibit dispensing of the material. In another embodiment, the external portion of the actuating means includes a lever member. The securing means includes a latch member having a notch adjacent one end thereof and an electrically activatable member for moving the latch member into engagement with the lever member in response to the predetermined condition (e.g., the onset of the defrost cycle) and for disengaging the latch member from the lever member in the absence of the predetermined condition (e.g., the cessation of the defrost cycle). The lever member is received in the notch to inhibit movement thereof when the latch member is engaged with the lever member. In the preferred embodiment, the electrically activatable member is a solenoid.

In accordance another unique feature of the invention, diffusion means is mounted with the valve body. The diffusion means has a conduit communicating with the valve bore, such that the material is dispensed through the conduit when the closure means is in the second position. The diffusion means further includes a diffusion member for diffusing the material generally outwardly from a central longitudinal axis of the conduit and downwardly. The longitudinal axis of the conduit is oriented generally transversely relative to a longitudinal axis of the bore.

In one embodiment the diffusion means is a diffusion valve having a valve seat located in the conduit and the diffusion member is a diffusion ball. The diffusion valve further includes a biasing member for biasing the diffusion ball toward the valve seat to substantially inhibit passage of the material through the conduit. The material is stored in the container under sufficient pressure such that when the closure means is in the second position, the material is discharged from the container and through the bore so as to overcome the force of the biasing member and to disengage the diffusion ball from the valve seat, whereby the material is allowed to be dispensed through the conduit.

In another embodiment, the diffusion member is a plug located in the conduit. The plug has at least one slot disposed laterally with respect to a central longitudinal axis of the plug for directing the material generally outwardly from the central longitudinal axis of the conduit and downwardly.

In accordance with yet another feature of the invention, the valve body has a female threaded portion and the diffusion means has a male threaded portion adapted for mating engagement with the female threaded portion. The diffusion means is therefore removably mounted with the valve body, with the central longitudinal axis of the conduit being oriented generally transversely with respect to the longitudinal axis of the valve bore.

In accordance with the present invention, the securing means engages the lever member of the valve actuating means external to the valve body so that the lockout condition is readily apparent to a person desiring to operate the lever member. Thus, the lever member is rendered inoperable in response to the predetermined condition (e.g., during the defrost cycle) to prevent the material from being dispensed. The diffusion valve located in the conduit substantially inhibits leakage of material when the dispensing valve is closed. Further, the threaded connection between the diffusion means and the valve body allows the diffusion means to be removed for cleaning. Yet another advantage of the present invention is that the longitudinal axis of the diffusion means conduit is oriented generally transversely with respect to the longitudinal axis of the dispensing valve bore, which not only reduces the dispensing pressure, but also further inhibits leakage.

BEST MODE FOR CARRYING OUT THE INVENTION

Figure 1:
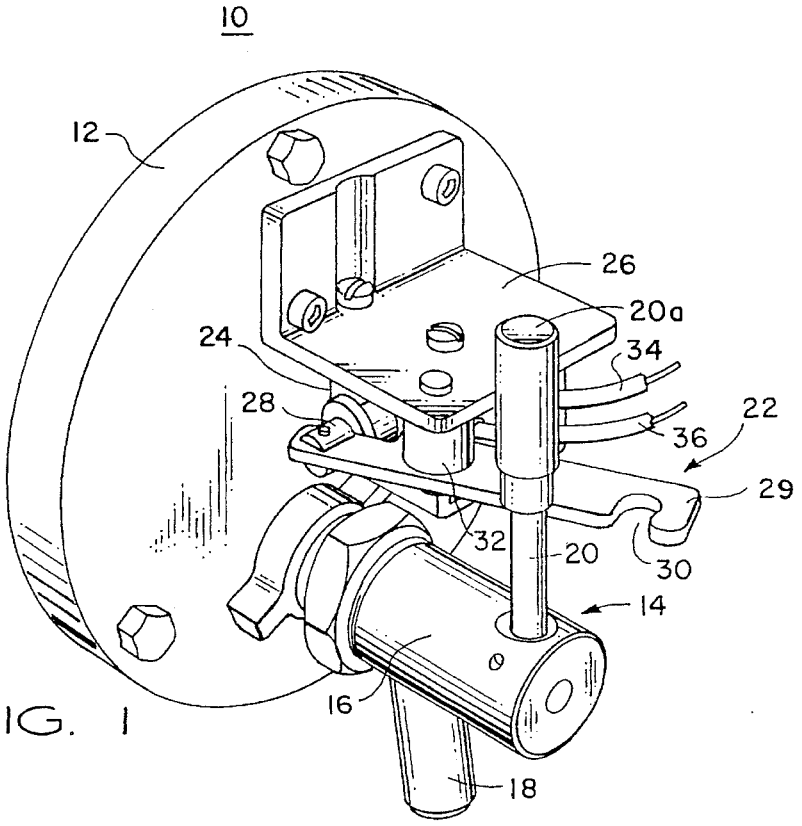
FIG. 1 is a perspective view of a frozen beverage dispensing apparatus, according to the present invention, showing a latch member in a disengaged position.
Figure 2:
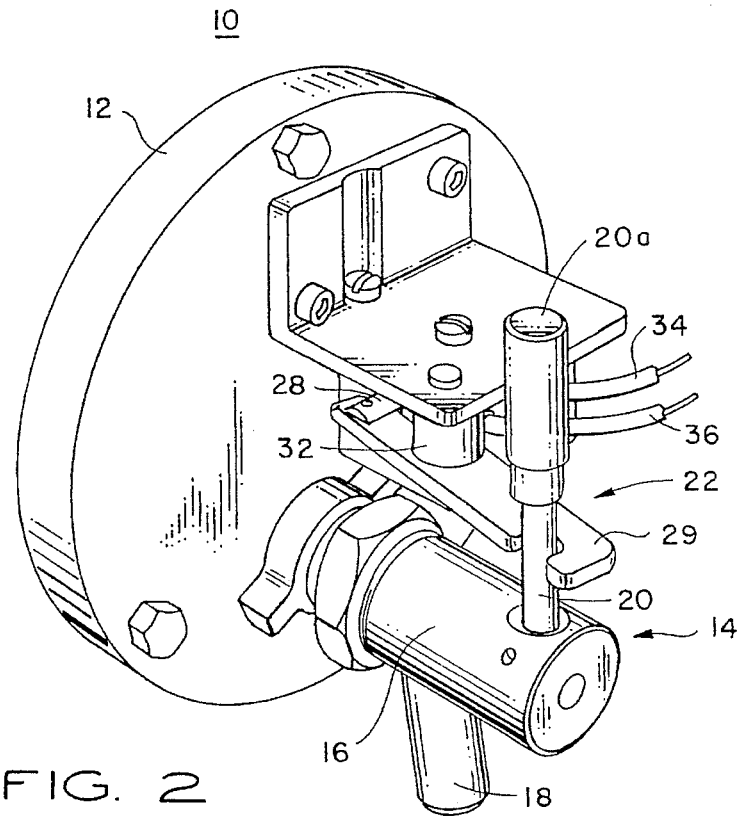
FIG. 2 is a perspective view of the apparatus of FIG. 1, showing the latch member engaged with a manually operable lever member.
Figure 3:
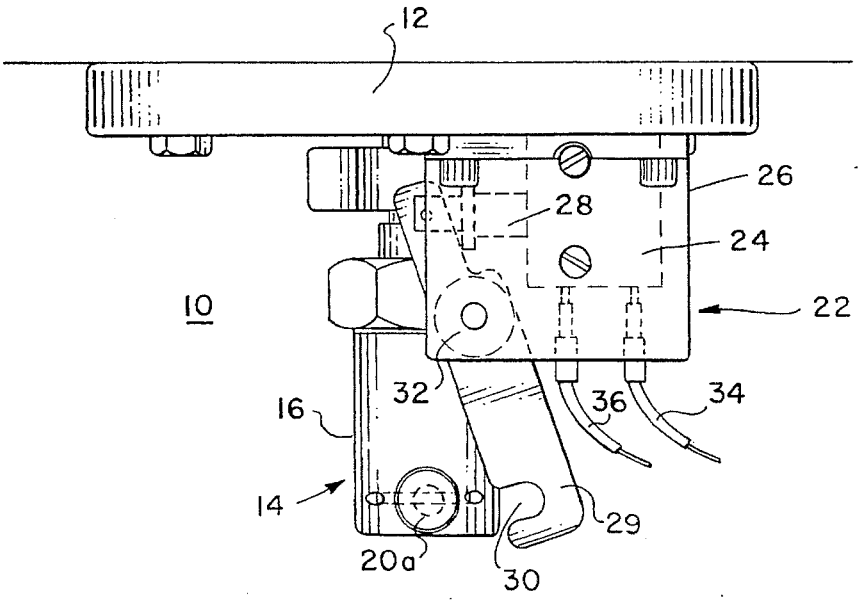
FIG. 3 is a top plan view of the dispensing apparatus, showing the latch member disengaged from the lever member.
Figure 4:
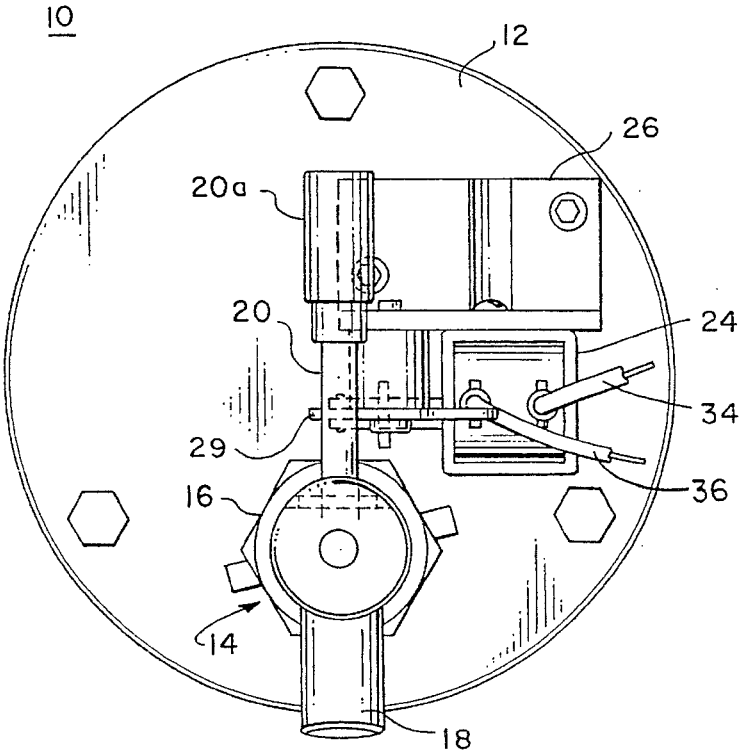
FIG. 4 is an end elevation view of the dispensing apparatus, showing the latch member engaged with the lever member.

In the description which follows, like parts are marked throughout the drawings with the same respective reference numerals. The drawings are not necessarily to scale and in some instances proportions may have been exaggerated in order to more clearly describe the invention.

Referring to the FIGS. 1–6, apparatus 10 for dispensing material in at least a partially frozen state is depicted. The material is preferably frozen or semi-frozen with the consistency of a slush. For example, the material may be with frozen beverage. Apparatus 10 includes a storage tank 12, which is operably connected to a refrigeration system (not shown) for cooling the interior of tank 12 to maintain the beverage stored therein in a frozen or semi-frozen state.

A dispensing valve 14 is mounted with tank 12. Valve 14 includes a valve body 16, a dispensing faucet 18 depending downwardly from valve body 16 and a manually operable lever member 20 mounted for tilting movement. Lever member 20 is provided for operating valve 14, as will be described- in greater detail hereinafter.

A securing device 22 is provided for securing lever member 20 in response to a predetermined condition. An electrically activatable solenoid 24 is mounted with tank 12 by means of an L-shaped mounting bracket 26. Solenoid 24 has a movable member 28 coupled to an elongated latch member 29 adjacent one end of latch member 29. Latch member 29 has a notch 30 adjacent an opposite end of latch member 29 from moveable member 28. Pivot mounting member 32 is carried on mounting bracket 26 for mounting latch member 29 for pivotal movement about a vertical axis. Electric wires 34 and 36 connect solenoid 24 to an electrical power source (not shown).

Figure 5:
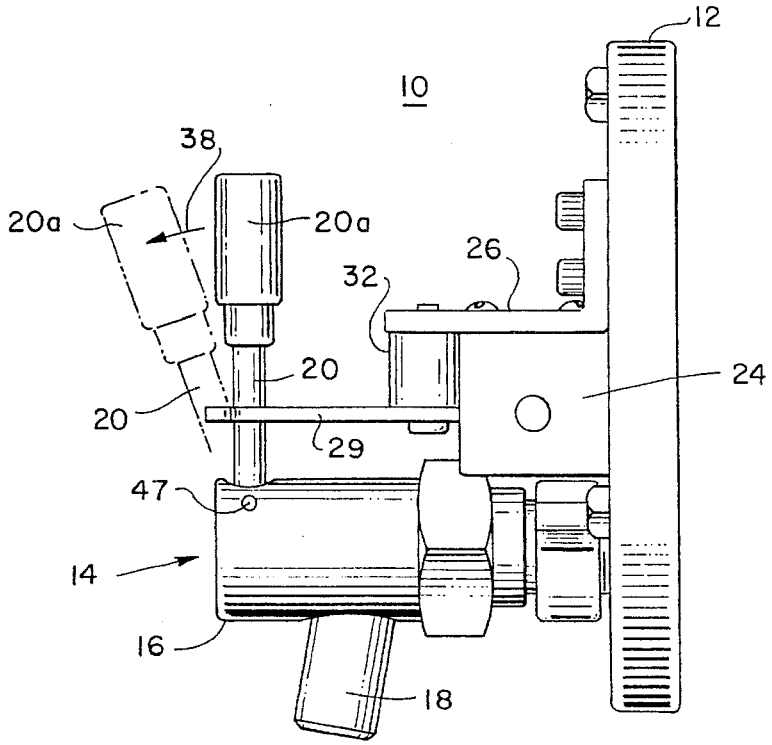
FIG. 5 is a side elevation view of the dispensing apparatus, illustrating the tilting movement of the lever member.
Figure 6:
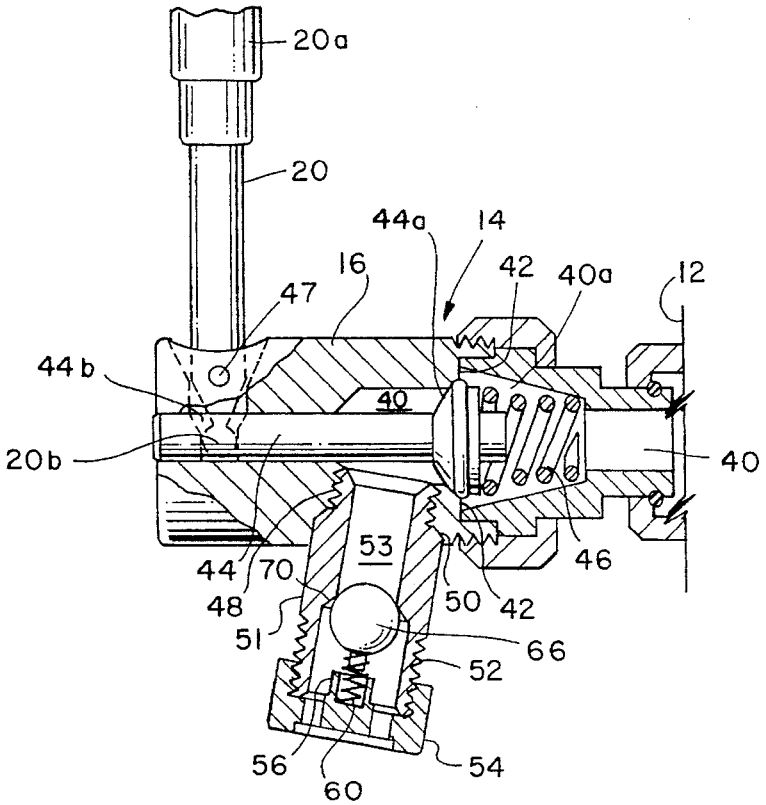
FIG. 6 is a cross-sectional view of the dispensing valve associated with the dispensing apparatus.

As can be best seen in FIG. 5, lever member 20 is mounted for fore and aft tilting movement, as indicated by arrow 38, for operating valve 14, as will be described in greater detail hereinafter. Lever member 20 has a handle portion 20*a* to facilitate manual operation of lever member 20. As shown in FIG. 6, valve body 16 has a generally elongated bore 40 communicating with the interior of tank 12. An intermediate portion 40*a* of bore 40 is conical-shaped to define a shoulder 42, which functions as a seating surface for a valve actuating member 44 which is reciprocally movable within bore 40. Actuating member 44 has a conical end portion 44*a* which functions as a seat member by engaging shoulder 42 to close off bore 40 and prevent passage of the material therethrough. Valve 14 is shown in a closed position in FIG. 6. A spring member 46 biases actuating member 44 toward the closed position shown in FIG. 6. When actuating member 44 is in the closed position, lever member 20 is oriented substantially vertically, as shown in FIG. 6.

End 20*b* of lever member 20, which is opposite from handle portion 20*a*, is received within an opening 44*b* in actuating member 44. Lever member 20 is pivotally mounted with valve body 16 by means of a pivot pin 46, such that when lever member 20 is tilted in an aft direction as indicated by arrow 38 in FIG. 5, end 20*b* is moved in a forward direction (i.e., toward tank 12), thereby disengaging end portion 44*a* from shoulder 42. The torque applied to lever member 20 overcomes the force of spring member 46, thereby compressing spring member 46 as actuating member 44 is moved in the direction of tank 12.

Faucet member 18 is preferably threadedly connected to valve body 16. Faucet member 18 has a cylindrical first male threaded portion 48, an outwardly tapered portion 50, a cylindrical non-threaded portion 51 and a cylindrical second male threaded portion 52. Faucet member 18 has an internal passageway 53 communicating with bore 40. Passageway 53 provides a conduit for the dispensing of the frozen beverage. First threaded portion 48 is engageable with complementary female threads inside valve body 16, such that faucet member 18 is oriented generally transversely with respect to the longitudinal axis of bore 40. A cap 54 with female threads engages the complementary male threads of second male threaded portion 52.

Figure 7:
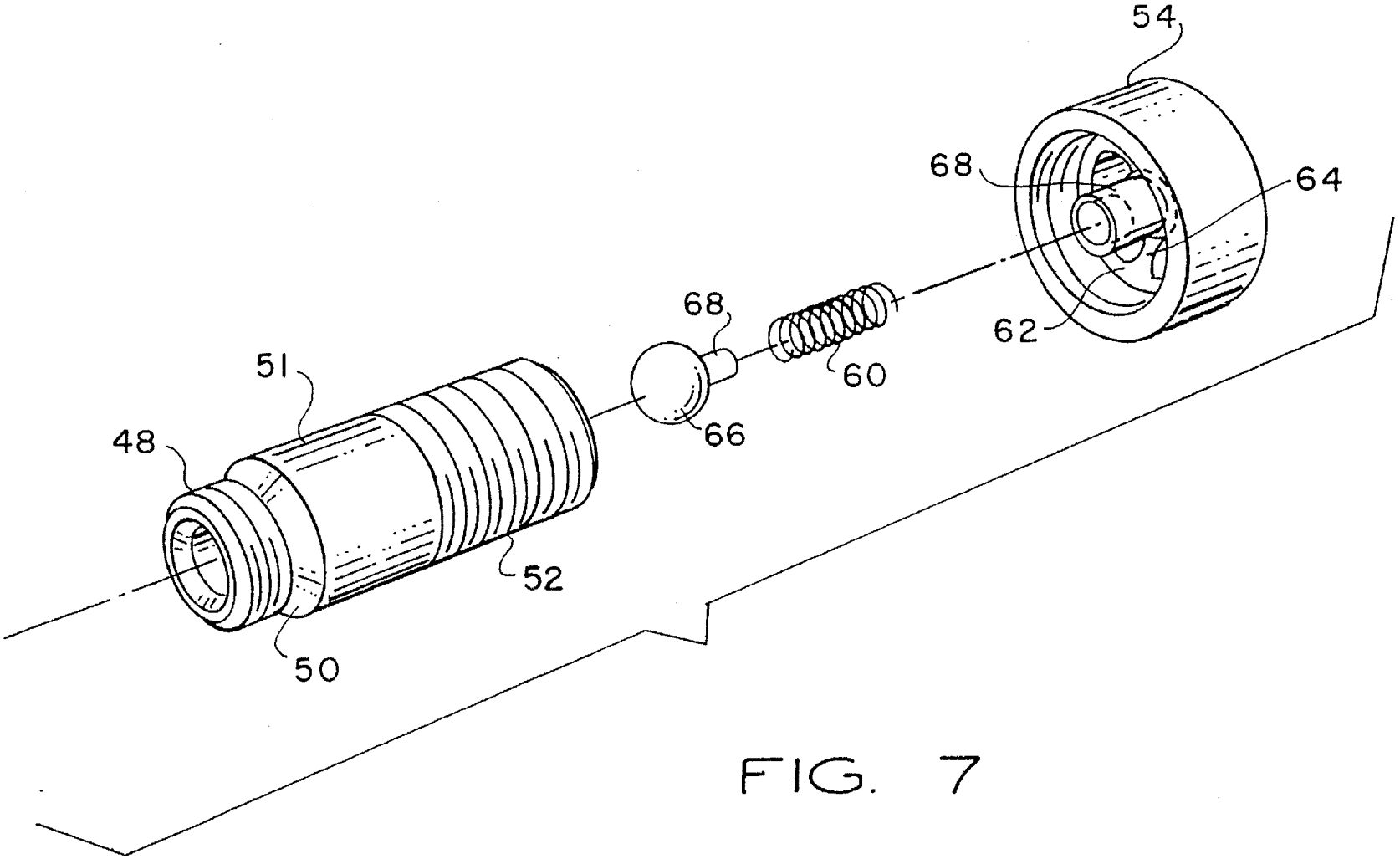
FIG. 7 is an exploded perspective view of a diffusion ball valve associated with the dispensing apparatus.

Referring to FIGS. 6 and 7, cap 54 has a central boss 56 with an opening 58 for receiving a spring member 60. Cap 54 also includes an annular surface 62 and two radial spokes 64 extending between annular surface 62 and boss 56. Annular surface 62 and spokes 64 reduce the dispensing pressure by directing the frozen beverage radially inward. As such, annular surface 62 and spokes 64 function as a nozzle.

A diffusion ball 66 is located in passageway 53. Ball 66 has a stem 68, which is received within spring member 60, whereby ball member 66 is biased toward tapered seating surface 70 inside tapered portion 50. Spring member 60, diffusion ball 66 and tapered seating surface 70 cooperate to define a diffusion valve, to prevent leakage of the frozen beverage from bore 40 after actuating member 44 has been returned to a closed position by spring 46. When actuating member 44 is moved to an open position, the pressure of the frozen beverage passing around end portion 44*a* overcomes the biasing force of spring member 60, such that diffusion ball 66 is disengaged from seating surface 70. The frozen beverage passing around diffusion ball 66 is diffused outwardly from a central longitudinal axis of passageway 53, thereby breaking up the flow of the frozen beverage and reducing the pressure thereof as the frozen beverage is dispensed through passageway 53. The nozzle defined by annular surface 62 and spokes 64 further inhibits the axial flow of the frozen beverage through passageway 53, as previously described. The threaded connection between cap 54 and second male threaded portion 52 and the threaded connection between first male threaded portion 48 and valve body 16 allows faucet member 18 to be removed from valve body 16 for cleaning. One skilled in the art will also recognize that the transverse orientation of faucet member 18 with respect to the longitudinal axis of bore 40 further reduces the dispensing pressure because there is no direct axial flow of the frozen beverage through valve bore 40 and faucet member 18.

Figure 8:
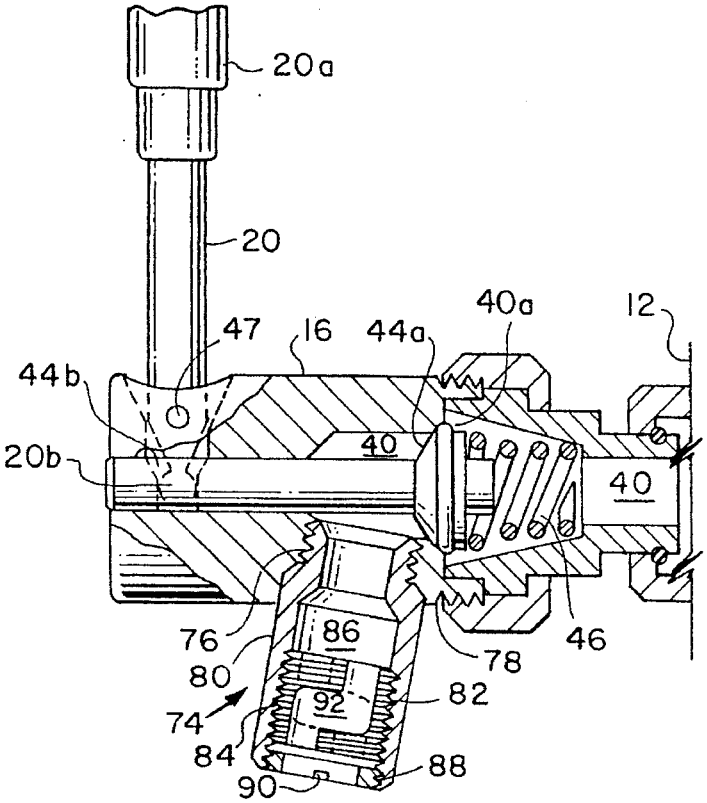
FIG. 8 is a cross-sectional view of an alternate embodiment of a diffusion device, according to the present invention.
Figure 9:
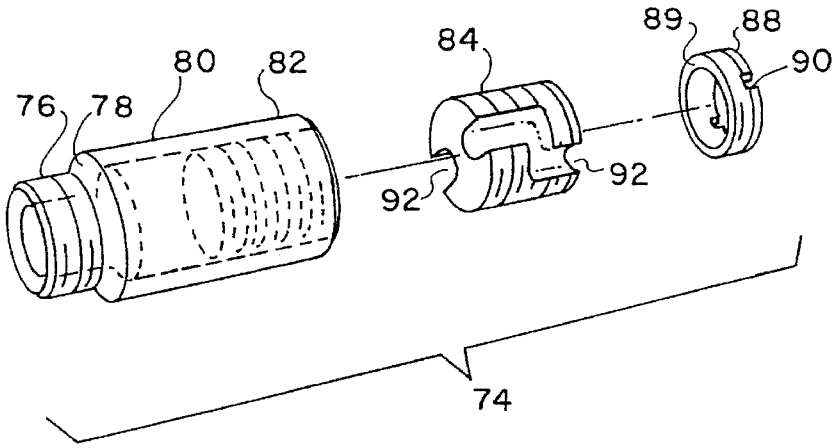
FIG. 9 is an exploded perspective view of the diffusion device of FIG. 8.
Figure 10:
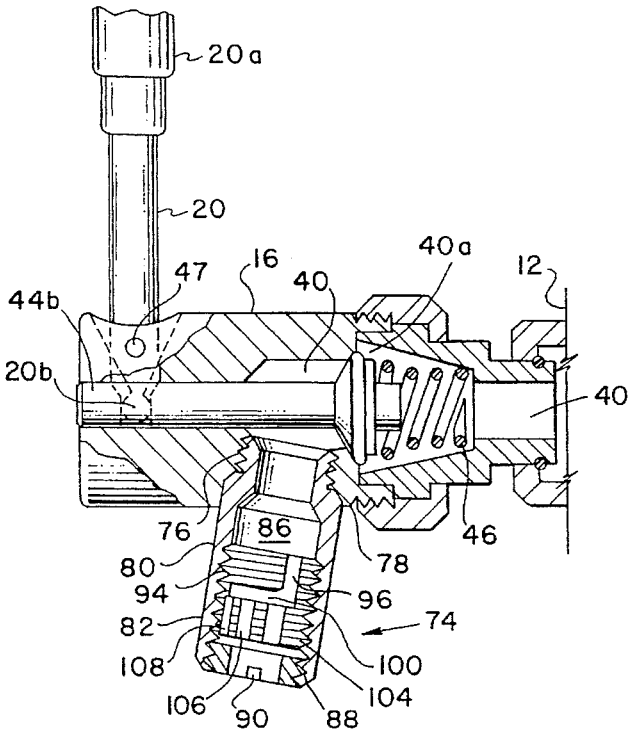
FIG. 10 is a cross-sectional view of another alternate embodiment of a diffusion device, according to the present invention.
Figure 11:
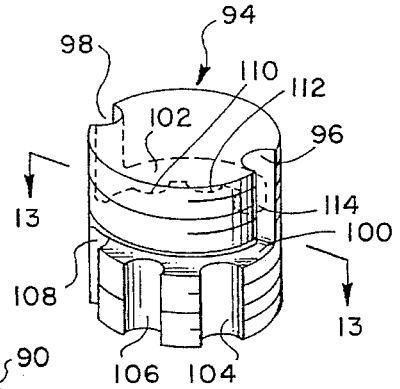
FIG. 11 is a perspective view of a plug member of the diffusion device of FIG. 10.
Figure 12:
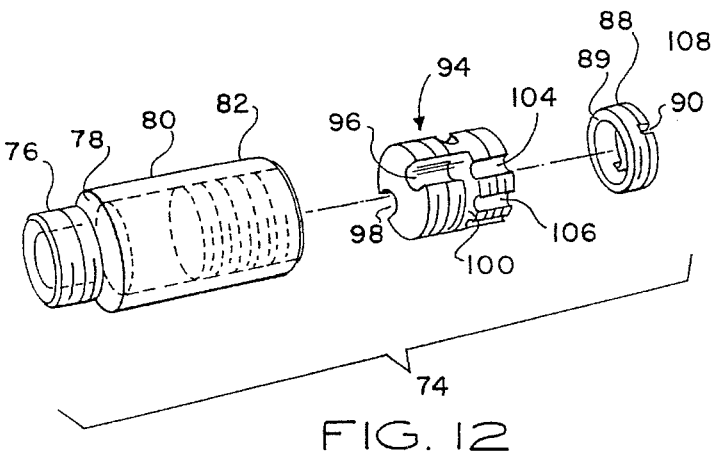
FIG. 12 is an exploded perspective view of the diffusion device of FIG. 10.
Figure 13:
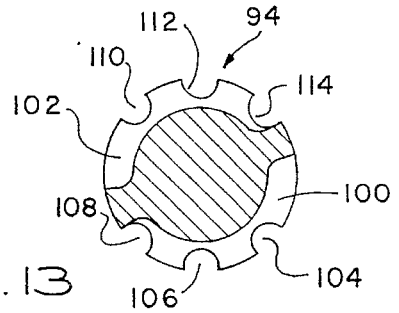
FIG. 13 is a cross-sectional view of the plug member, taken along the line 13—13 of FIG. 11.

Referring to FIGS. 8 and 9, another embodiment of a diffusion device is depicted. In FIGS. 8 and 9, faucet member 74 has a different configuration from faucet member 18 described above with reference to FIGS. 1–7. Faucet member 74 has a cylindrical male threaded portion 76, an outwardly tapered portion 78, a cylindrical non-threaded portion 80 and a cylindrical female threaded portion 82. A substantially cylindrical, male threaded plug 84 is received within an internal passageway 86 of faucet member 74. Plug 84 is in threaded engagement with female threaded portion 82. A male threaded nozzle member 88 is also in threaded engagement with female threaded portion 82 beneath plug 84. Nozzle member 88 has an annular surface 89 for inhibiting the axial flow of the frozen beverage through passageway 86. Nozzle member 88 further includes a pair of diametrically opposed notches 90 to facilitate disengagement of nozzle member 88 from female threaded portion 82.

Plug 84 has two diametrically opposed slots 92 disposed laterally with respect to a central longitudinal axis of plug 84. Slots 92 each have a downwardly extending inlet portion 92*a*, an intermediate portion 92*b* extending partially around plug 84 and a downwardly extending outlet portion 92*c*. Inlet portions 92*a* extend from an upstream end of plug 84, parallel to the central longitudinal axis thereof, to the respective intermediate portions 92*b*. Intermediate portions 92*b* extend laterally relative to the respective inlet and outlet portions 92*a* and 92*c*. Outlet portions 92*c* extend from the respective intermediate portions 92*b* to a downstream end of plug 84, parallel to the central longitudinal axis thereof. Plug 84 therefore interrupts the direct axial flow of the frozen beverage through passageway 86.

In operation, the frozen beverage flowing downwardly through passageway 82 encounters plug 84 and is channeled laterally into the respective inlet portions 92*a*. The beverage flows downwardly through inlet portions 92*a* into respective intermediate portions 92*b*. The beverage then flows laterally through intermediate portions 92*b* into the respective outlet portions 92*c* and exits plug 84 through outlet portions 92*c*.

Referring to FIGS. 10–13, yet another embodiment of the diffusion device is depicted. The diffusion device shown in FIGS. 10–13 is substantially the same as the diffusion device shown in FIGS. 8 and 9, except that plug 84 has been replaced by a substantially cylindrical, male threaded plug 94. Plug 94 is received within internal passageway 86 and is in threaded engagement with female threaded portion 82. Nozzle member 88 is also provided and serves the same function as previously described with respect to FIGS. 8 and 9.

Plug 94 has two diametrically opposed inlet slots 96 and 98 disposed laterally with respect to a central longitudinal axis of plug 94, two semi-circumferential slots 100 and 102, and six outlet slots 104, 106, 108, 110, 112 and 114. Inlet slots 96 and 98 extend from an upstream end of plug 94, parallel to the central longitudinal axis thereof, to the respective slots 100 and 102, such that inlet slots 96 and 98 are in fluid communication with respective slots 100 and 102. Slots 100 and 102 extend laterally relative to respective inlet slots 96 and 98. Each slot 100, 102 extends approximately 180° around plug 94. Slots 100 and 102 are divided by diametrically opposed sections of plug 94, such that slots 100 and 102 are not in fluid communication. Slots 104, 106 and 108 extend from slot 100 to a downstream end of plug 94, parallel to the central longitudinal axis thereof. Slots 100, 112 and 114 extend from slot 102 to the downstream end of plug 94, parallel to the central longitudinal axis thereof. Slots 104, 106 and 108 are in fluid communication with slots 100 and 96, while slots 110, 112 and 114 are in fluid communication with slots 102 and 98. Slots 104, 106, 108, 110, 112 and 114 are preferably spaced at equal angular intervals around the circumference of plug 94 (i.e., at 60° angular intervals). Plug 94 therefore interrupts the direct axial flow of the frozen passageway through passageway 86.

In operation, the frozen beverage flowing downwardly through passageway 86 encounters plug 94 and is channeled laterally into slots 96 and 98. The beverage flows downwardly through slots 96 and 98 into the respective slots 100 and 102. The beverage then flows laterally through slots 100 and 102 into slots 104, 106, 108, 110, 112 and 114 and exits plug 94 via slots 104, 106, 108, 110, 112 and 114.

Various embodiments of the invention have now been described in detail. Since various changes in and modifications of the above-described preferred embodiments may be made without departing from the nature, spirit and scope of the invention, the invention is not to be limited to the aforementioned details.

What is claimed is:

1. Apparatus for dispensing material in at least a partially frozen state, said apparatus having a container for storing the material under pressure and a valve mounted with the container for controlling the dispensing of the material, said valve including a valve body with a bore communicating with the interior of the container, closure means disposed in the bore and being adapted to close the bore to prevent the material from passing therethrough when the closure means is in a first position, and actuating means for moving the closure means to a second position whereby the material is allowed to pass through the bore, the closure means being normally in said first position, a portion of the actuating means being external to the valve body, the improvement comprising securing means for automatically engaging said external portion of said actuating means in response to a predetermined condition to prevent said actuating means from being able to move said closure means to said second position, whereby said closure means is secured in said first position to prevent the material from being dispensed.

2. Apparatus of claim 1 wherein said predetermined condition corresponds to a defrost cycle of said apparatus, said securing means securing said valve in a closed position during the defrost cycle to inhibit the dispensing of the material.

3. Apparatus of claim 1 wherein said external portion of said actuating means includes a lever member, said securing means including a latch member having a notch adjacent one end thereof and an electrically activatable member for moving said latch member into engagement with said lever member in response to said predetermined condition and for disengaging said latch member from said lever member in the absence of said predetermined condition, said lever member being received in said notch to inhibit movement of said lever member when said latch member is engaged with said lever member.

4. Apparatus of claim 3 wherein said predetermined condition corresponds to a defrost cycle of said apparatus.

5. Apparatus of claim 4 wherein said latch member is mounted for pivotal movement, said latch member being pivotally movable by said electrically activatable member in a first direction into engagement with the lever member and in a second direction opposite from said first direction for being disengaged from the lever member.

6. Apparatus of claim 5 wherein said securing means further includes a relay member for operating said electrically activatable member to move said latch member in said first direction in response to said predetermined condition and in said second direction in response to the absence of said predetermined condition.

7. Apparatus of claim 6 wherein said electrically activatable member includes a solenoid.

8. Apparatus of claim 6 wherein said predetermined condition corresponds to a defrost cycle of said apparatus during which the material stored in the container is substantially melted.

9. Apparatus for dispensing material in at least a partially frozen state, said apparatus comprising:

a container for storing the material under pressure;

a valve mounted with said container for controlling the dispensing of the material, said valve having a valve body with a bore communicating with the interior of said container, closure means disposed in said bore and being adapted to close the bore to prevent the material from passing therethrough when the closure means is in a first position, and actuating means for moving said closure means to a second position, whereby the material is allowed to pass through the bore, said closure means being normally in said first position; and diffusion means mounted with said valve body, said diffusion means having a conduit with an internal passageway communicating with said bore, the material being allowed to pass through said bore for being dispensed through said conduit when said closure means is in said second position, said diffusion means further including a diffusion member for diffusing the material generally outwardly from a central longitudinal axis of said conduit and downwardly, the central longitudinal axis of said conduit being oriented generally transversely relative to a longitudinal axis of said bore.

10. Apparatus of claim 9 wherein a portion of said actuating means is external to said valve body, said apparatus further including securing means for automatically engaging said external portion of said actuating means in response to a predetermined condition to prevent said actuating means from being able to move said closure means to said second position, whereby said closure means is secured in said first position to prevent the material from being dispensed.

11. Apparatus of claim 10 wherein said predetermined condition corresponds to a defrost cycle of said apparatus during which the material in the container is substantially melted.

12. Apparatus of claim 10 wherein said external portion of said actuating means includes a lever member, said securing means including a latch member having a notch adjacent one end thereof and an electrically activatable member for moving said latch member into engagement with said lever member in response to said predetermined condition and for disengaging said latch member from said lever member in the absence of said predetermined condition, said lever member being received in said notch to inhibit movement of said lever member when said latch member is engaged with said lever member.

13. Apparatus of claim 12 wherein said securing means further includes a relay member for operating said electrically activatable member to move said latch member in a first direction for engaging said lever member in response to said predetermined condition and to move said latch member in a second direction opposite from said first direction for disengaging said latch member from said lever member in the absence of said predetermined condition.

14. Apparatus of claim 9 wherein said diffusion means includes a diffusion valve having a valve seat located in said passageway, said diffusion member being a diffusion ball, said diffusion valve further including a biasing member for biasing said diffusion ball toward said valve seat to substantially inhibit the passage of material through said conduit, the material being stored in said container under sufficient pressure such that said when said closure means is in said second position, the material is discharged from said container and through said bore so as to overcome said biasing member and to disengage the diffusion ball from said valve seat, whereby the material is allowed to be dispensed through said conduit.

15. Apparatus of claim 14 wherein said biasing member is a spring member for biasing said diffusion ball into engagement with said valve seat.

16. Apparatus of claim 9 wherein said valve body has a female threaded portion and said diffusion means has a male threaded portion adapted for mating engagement with said female threaded portion, said diffusion means being removably mounted with said valve body.

17. Apparatus of claim 9 wherein said diffusion member is a plug located in said passageway, said plug having at least one slot disposed laterally with respect to a central longitudinal axis of said plug for directing the material generally laterally with respect to said central longitudinal axis of said conduit and downwardly.

18. Apparatus of claim 9 wherein said diffusion member is a plug located in said passageway, said plug having first and second slots disposed laterally with respect to a central longitudinal axis of said plug, each of said slots having an inlet portion extending parallel to said central longitudinal axis, an intermediate portion extending laterally with respect to said central longitudinal axis and an outlet portion extending parallel to said central longitudinal axis, said inlet and outlet portions being adapted to direct the material generally downwardly and parallel to said central longitudinal axis, said intermediate portions being adapted to direct the material generally laterally with respect to said central longitudinal axis.

19. Apparatus of claim 9 wherein said diffusion member is a plug located in said passageway, said plug having first, second, third, fourth, fifth, sixth, seventh, eighth, ninth and tenth slots, said first and second slots being disposed laterally with respect to a central longitudinal axis of said plug and extending parallel to said central longitudinal axis, said third and fourth slots being in fluid communication with the respective first and second slots and extending at least partially around said plug and laterally with respect to said central longitudinal axis, said fifth, sixth and seventh slots being in fluid communication with said third slot and extending parallel to said central longitudinal axis, said eighth, ninth and tenth slots being in fluid communication with said fourth slot and extending parallel to said central longitudinal axis, said third and fourth slots being adapted to direct material flowing therethrough laterally with respect to said central longitudinal axis, said first, second, fifth, sixth, seventh, eighth, ninth and tenth slots being adapted to direct material flowing therethrough generally downwardly and parallel to said central longitudinal axis, said first and second slots communicating between an upstream end of said plug and the respective third and fourth slots, said fifth, sixth and seventh slots communicating between said third slot and a downstream end of said plug, said eighth, ninth and tenth slots communicating between said fourth slot and said downstream end of said plug.

20. A valve for controlling the dispensing of material from a container in which the material is stored under pressure in at least a partially frozen state, said valve comprising:

a valve body having a bore communicating with the interior of the container;

closure means disposed in said bore and being adapted to close the bore to prevent the material from passing therethrough when the closure means is in a first position;

actuating means for moving said closure means to a second position whereby the material is allowed to pass through the bore, said closure means being normally in said first position, a portion of said actuating means being external to said valve body; and securing means for automatically engaging said external portion of said actuating means in response a predetermined condition to prevent said actuating means from being able to move said closure means to said second position, whereby said closure means is secured in said first position to prevent the material from being dispensed.

21. The valve of claim 20 further including diffusion means mounted with said valve body, said diffusion means having a conduit with an internal passageway communicating with said bore, the material being allowed to pass through said bore for being dispensed through said conduit when said closure means is in said second position, said diffusion means further including a diffusion member for diffusing the material generally outwardly from a central longitudinal axis of said passageway and downwardly, the central longitudinal axis of said passageway being oriented generally transversely relative to a longitudinal axis of said bore.

22. The valve of claim 20 further including biasing means for biasing said closure means toward said first position.

* * * * *